United States Patent [19]

Petri et al.

[11] Patent Number: 4,698,990

[45] Date of Patent: Oct. 13, 1987

[54] METHOD FOR SUPPORT ROLLER ADJUSTMENT IN STRAIGHTENING MACHINES

[75] Inventors: Otto Petri; Werner Baeumer, both of Siegen-Weidenau; Dieter Ohrendorf, Siegen, all of Fed. Rep. of Germany

[73] Assignee: Fr, W. Schnutz GmbH & Co, Siegen-Weidenau, Fed. Rep. of Germany

[21] Appl. No.: 786,316

[22] Filed: Oct. 10, 1985

[30] Foreign Application Priority Data

Oct. 16, 1984 [DE] Fed. Rep. of Germany ..... 3437777

[51] Int. Cl.[4] ..... B21D 1/02

[52] U.S. Cl. ..... 72/21; 72/165

[58] Field of Search ..... 72/165, 164, 160, 7, 72/21

[56] References Cited

U.S. PATENT DOCUMENTS

| | | | |
|---|---|---|---|
| 2,049,142 | 7/1936 | Ungerer | 72/165 |
| 2,091,789 | 8/1937 | Maussnest | 72/165 |
| 3,236,079 | 2/1966 | Ungerer | 72/7 |

*Primary Examiner*—Daniel C. Crane
*Attorney, Agent, or Firm*—Michael J. Striker

[57] ABSTRACT

A straightening machine includes an array of flexible straightening rollers and an array of complementary rollers which alternate with the straightening rollers in direction normal to the axes of such rollers, the complementary rollers being arranged at a major surface of a deformable sheet-shaped material that faces oppositely to another major surface at which the straightening rollers are situated. A plurality of support rollers supports the respective straightening rollers, the support rollers being distributed along the length of the straightening roller and being individually adjustable as to their position with respect to a support roller alignment plane. During the straightening operation, a predetermined number of the support rollers is selectively positionally adjusted, and the remaining rollers are automatically positionally adjusted until abutment of all support rollers at the straightening roller is achieved, by simulataneously calculating the expression $V/=/A/\cdot P/+F/$, wherein V/ is a multidimensional vector of the support roller adjustment, /A/ is a matrix of parametric values, P/ is a multidimensional vector of the support forces, and F/ is a multidimensional vector of the straightening load, and adjusting the positions of the support rollers in accordance with the so obtained values.

7 Claims, 4 Drawing Figures

METHOD FOR SUPPORT ROLLER ADJUSTMENT IN STRAIGHTENING MACHINES

BACKGROUND OF THE INVENTION

The present invention relates to straightening machines for deformable materials in general, and more particularly to a straightening machine for straightening sheet-shaped deformable materials during their advancement, as well as to a correspond ing straightening method.

There are already known various constructions of straightening machines for deformable materials, among them such in which a sheet or a band of such deformable material is introduced and advanced between an array of straightening rollers and an array of complementary rollers which alternate with one another as considered in a direction normal to their axes. In a machine of this construction, it is known to make the respective straightening roller flexible and to support the same on a plurality of support rollers which are distributed along the length of the straightening roller and are positionally adjustable beyond a support roller alignment plane or axis to deform the flexible straightening roller to the desired spatial configuration, so that the straightening roller correspondingly deforms the sheet-shaped material. The reason for providing and using such straightening machines is that, as is well known, planarity errors are encountered during or as a result of rolling, winding or cutting of bands and sheets of deformable materials, especially metallic materials. Such errors are, more often than not, unacceptable nowadays, especially in view of the constantly rising demands on the quality of the finished articles manufactured from such sheet-shaped materials, such as, for instance, decorative metal sheets, motor vehicle bodies or railroad car walls, and ship and airplane panels or walls.

In view of this, it has been known for some time to subject such bands, strips or sheets, for instance after their cutting from a coil, to a straightening operation or process, during which the planarity of such sheet-shaped materials is restored or achieved. During this process, both the developable (two-dimensional) and the non-developable (three-dimensional) curvatures are removed. Herein, the three-dimensional curvatures, which come into being most often during a rolling operation as a result of different lengthening of the fibers of the band being rolled, require the greater mechanical straightening effort.

The straightening operation resides in that the straightening rollers (respectively the respective "straightening roller arrays" which are constituted by the straightening rollers arranged downstream from one another) are immersed or introduced over their effective lengths, which must amount to somewhat more than the width of the deformable sheet material to be straightened to different extents between the complementary rollers. In this manner, the material being straightened is stretched at the regions of increased immersion depth of the straightening rollers with respect to the material fibers parallel thereto at the regions of lesser immersion depth. It is thus achieved in this manner that the material fiber lengths are equalized with one another.

In order to obtain different immersion depths between the complementary rollers over the effective lengths of the respective straightening rollers, the straightening rollers must be elastically deformed. Thus, it has already been proposed to utilize support rollers which support the respective straightening roller at longitudinally spaced regions of the latter for this purpose. The support rollers are separate from one another and are distributed over the effective length of the straightening roller. Depending on the width of the material to be straightened, between 3 and about 13 or even more of such support rollers are used for each of the straightening rollers. The support rollers then supporr the respective straightening roller against the forces exerted on the latter by the material being straightened.

When all of the support rollers are aligned with one another, that is, when they lie along a support roller alignment axis or plane and their axes coincide therewith, such axis or plane being tangential to the straightening roller and to the support rollers at their region of contact, then even the straightening roller is straight. On the other hand, when the position of one of the support rollers is elevated or displaced beyond the support roller alignment plane, then the flexible straightening roller is, as expected, elastically bent or deformed and in this manner the immersion depth of the straightening roller at this region between the complementary rollers is correspondingly increased with attendant stretching of the material being straightened at the corresponding fiber.

A considerable disadvantage of known straightening arrangements and associated methods of this kind results from the fact that positional adjustment not only of the respective determinative support roller, that is, the support roller whose position is selectively adjusted in order to achieve the desired straightening effect, but also of the remaining neighboring support rollers associated with the same straightening roller, must be accomplished during the operation of the straightening machine. The criterion for the positional adjustment and the positional readjust ment of the predeterminative support roller, on the one hand, and of the remaining support rollers, on the other hand, is the "best straightening result" in the material being straightened.

Each of these adjustment operations requires a relatively huge length of the material being straightened. Thus, when the predeterminative support roller is positionally adjusted first after the required immersion depth thereof has been determined, and then the needed immersion depths of the remaining support rollers are established and readjustment of such rollers is performed, the the material being straightened that has been "used" so far cannot be straightened by utilizing the finally found adjustment, inasmuch as the straightening conditions precisely for this sheet-shaped material have completely changed in the meantime.

SUMMARY OF THE INVENTION

Accordingly, it is a general object of the present invention to avoid the disadvantages of the prior art.

More particularly, it is an object of the present invention to develop a method of straightening deformable sheet-shaped materials, which method does not possess the disadvantages of the heretofore known methods of this type.

Still another object of the present invention is to devise a method of the type here under consideration which is relatively easy to perform and yet achieves excellent straightening results.

It is yet another object of the present invention to provide an arrangement which is particularly suited for the performance of the above-mentioned method.

A concomitant object of the present invention is so to construct the arrangement of the above type as to be relatively simple in construction, inexpensive to manufacture, easy to use, and reliable in operation nevertheless.

In pursuance of these objects and others which will become apparent hereafter, one feature of the present invention resides in a method of adjusting the positions of N support rollers which support a flexible straightening roller in a machine for straightening deformable sheet-shaped materials during the advancement of the latter between arrays of straightening and complementary rollers which are situated downstream of one another as considered in the advancement direction, with the straightening rollers being positionally adjustable with respect to the complementary rollers, this method comprising the steps of freely positionally adjusting selected K of the support rollers beyond a support roller alignment plane; and automatically positionally adjusting the remaining N-K support rollers upto abutment of all of the support rollers on the straightening roller on the basis of a simultaneous calculation of the expression $$V/=/A/\cdot P/+F/,$$

wherein V/ is a multidimensional vector of the support roller adjustment, /A/ is a matrix of parametric values, P/ is a multidimensional vector of the support forces, and F/ is a multidimensional vector of a straightening load.

A particular advantage of the present invention as described so far resides in the fact that now the predeterminative support rollers can be adjusted arbitrarily to achieve the desired straightening result, and that the remaining free support rollers are automatically positionally adjusted, after the calculation of the adjustment height from the function describing the deformation of the straightening roller, in such a manner that they securely abut the straightening roller. In this manner, the consideration and the correction of the operating condition following each of the adjustments by the operating personnel can be dispensed with. Thus, the dependence on the individual handiness and experience of the respective machine operator is substantially reduced. Moreover, the automatic positional readjustment of the free remaining support rollers into contact with or abutment against the straightening roller also constitutes a considerable improvement in the straightening capability of the respective straightening machine.

More particularly, since the load distribution over the straightening roller depends on the condition of the material being straightened, but the load distribution determines the deformation of the straightening roller, the positional adjustment of the predeterminative support rollers alone (with the free support rollers out of contact with the straightening roller) cannot determine the actual bending of the straightening roller for all operating conditions. Rather, the changes in the load distribution over the straightening roller by changing planarity errors of the material being straightened lead to changing deformations of the straightening roller and thus to changing stretchings of the material being straightened. As a result of this, the effect of an adjustment on the material being straightened is equivocal, and this considerably complicates the training of the operating personnel.

On the other hand, in the arrangement according to the present invention, the deformation condition is determined by the positional adjustment of the K predeterminative support rollers and remains the same at each load distribution, inasmuch as the subsequently readjusted free remaining support rollers intercept each load change by reactive support force changes. Thus, the deformation of the straightening roller remains generally unchanged.

As a result, there is opened, above all, also the possibility to accomplish the straightening of sheets and bands within an automatic, feedback-coupled control arrangement, inasmuch as the positional readjustment of the free remaining support rollers cannot suffer a build-up or become oscillatory, due to its dependency on and derivation from the positional adjustments of the predeterminative support rollers. The extent of adjustment of the free remaining rollers can be determined not only individually, but also simultaneously, that is, at the same time for all of the support rollers. The simultaneous equation system used in this case has the following form which is simple in vector representation:

$$V/(f(x1),\ldots,f(xi))=/Aii/\cdot P/(p(x1,\ldots,p(xi))+F/(x1\ldots xi) \quad (1)$$

wherein V/ is an i-dimensional vector from the displacements f at xi, P/ is an i-dimensional vector from the support forces p at xi, F/ is load distribution over the strightening roller, f(xi) is the displacement of the support roller at the position xi, and /Aii/ is a quadratic matrix of the parametric values, or, in an abbreviated form $$V/(f1,f2\ldots fi)=/A/\cdot P/(p1,p2\ldots pi)+F/(i) \quad (2)$$

$$V/=/A/\cdot P/+F/$$

After adjustment, the above expression becomes:

$$V/(f1,v2,\ldots vk,fi)=/A/\cdot P/(v1,v2,\ldots vk,vi)+F/(i), \quad (3)$$

wherein vi designate components changed with respect to the previous ones.

The new support forces can be determined by solving the above system for P/. Thus, the new support forces are $$P/(v1,v2\ldots vk,vi)-F/(i)=/A/exp-1\cdot V/(f1,v2,\ldots vk,fi), \quad (4)$$

wherein /A/exp−1 is an inverted matrix.

Herein, in the general case, negative loads will be encountered. However, such a situation constitutes an ambiguous operating condition for the straightening machine, since negative loads indicate that the support roller that is affected is not in contact with the straightening roller. Yet, as already alluded to before, when one or more of the support rollers is out of contact with the straightening roller, the effective support roller height becomes load dependent, and this is exactly what is to be avoided in accordance with the present invention.

This operating condition is terminated in that the support load at these locations is deliberately set to be zero, or a predetermined value greater than zero.The new vector P(v1,o2, . . . ok,vi) resulting from the vector P(v1,o2, . . . ok,vi) with negative components is then used for the redetermination of the adjustment vector V(v1,v2, . . . vi), while the previously adjusted components v2, vk are maintained intact. Thus, it applies $$V/(v1,v2 \ldots vi)=/A/\cdot P/(v1,o2 \ldots ok,vi)+F/(i), \quad (5)$$

wherein oi is the deliberately set support load of zero.

Now, it is again examined with this new set of support roller positions, by using the equation (4), whether or not negative loads are still or again encountered. If this is the case, then setting of these negative loads to zero and the subsequent recalculation of the new set of support loads are repeated, until negative loads are not encountered any longer. Thus, in the general case, the equations (4) and (5) must be used more than once.

The search for such sets of support roller positions which do not include any negative support loads is simplified in that the originally first adjusted support rollers are left unchanged during the following operations. This depends on the physical original position: inasmuch as the adjustment has taken place exactly at those regions where a planarity error occurred in the material being straightened, only the free support rollers can be brought into abutment with the straightening roller.

The matrix /A/ results from calculation from the respectively available or present straightening parameters: the machine constants, such as, for instance, the straightening roller length, the straightening roller diameter, the number of the support rollers, the support roller spacing, and the constants of the material being straightened, such as the thickness of the sheet material, the width of the sheet material, and the stretching limit.

The calculation of the inverted matrices /A/exp−1 associated with the matrix /A/ requires calculating time. Therefore, for increasing the calculation speed, the inverted matrices are stored in a storage medium. Thus, they are readily available for retrieval from the storage medium and for use in the respective calculation operation.

The readjustment of the free support rollers can also be accomplished in such a manner that the supports for the support rollers are provided with load sensors, that predeterminative K of the support rollers are selectively adjusted beyond the support roller alignment plane, that the after-adjustments of the remaining N-K free support rollers take place only for so long that the adjustment of the predeterminative support rollers continues, and that all N-K load sensors indicate a positive load.

In an arrangement of this type, the readjustment operation of the free remaining support rollers can be accomplished directly and rapidly during the "upward control", that is, during the increase of the displacement of the support rollers. However, in this instance, the control of the machine must be suspended, for example, when the end of the material being straightened (for instance, during the straightening of plates) is reached, in order for the control to remain stable. Thus, additional parameters are to be supervised and processed. The "downward control", that is, the diminishment of the adjustment distances, occurs by retraction of all support rollers utilizing a similarity transformation of the displacements of all of the support rollers.

It is further particularly advantageous when the adjustment of the predeterminative support rollers is performed in three stages, during a first one of which the loads applied to the remaining support rollers all have positive values after the performance of the free positional adjustment of the predeterminative support rollers, and the automatic positional adjustment of the remaining support rollers is performed only during the adjustment of the predeterminative support rollers, during a second one of which the positional adjustment of the remaining support rollers is calculated from the function descriptive of the deformation of the straightening roller and the adjustment is performed based on the thus calculated values, and during a third one of which a downward control of the extent of displacement of the support rollers is performed by the use of a similarity transformation while maintaining relative support roller displacement extents. The control criterion herein may be a predetermined total pressure between the straightening rollers and the complementary rollers, such total pressure resulting from a summation of the loads.

In accordance with a particularly advantageous facet of the present invention, the support rollers are actuatable and thus displaceable by hydraulic means, since as a result of this expedient feedback-controlled adjustments of the support rollers become especially simple. In particular, the use of hydraulically operated wedge arrangements leads to a robust construction which is accommodated to the operating conditions encountered during the straightening of metal sheets or plates.

In accordance with a further development of the invention, that one of the support rollers is the predeterminative one and is automatically adjusted, for which the oscillations of the material being straightened as determined by N sensors at N fibers have a minimum, wherein the extent of the adjustment is proportional to the oscillations, and the remaining N-1 support rollers are after-adjusted in their positions to the predeterminative support roller in accordance with the present invention. A particular advantage of this arrangement resides in the fact that now a control is possible which uses, for instance, the oscillation of the material to be straightened as measured before the performance of the straightening operation as a guiding value, and the oscillation measured after the straightening operation as a control value.

The novel features which are considered to be characteristic of the invention are set forth in particular in the appended claims. The improved straightening machine itself, however, both as to its construction and its mode of operation, together with additional features and advantages thereof, will be best understood upon perusal od the following detailed description of certain specific embodiments with reference to the accompanying drawing.

DETAILED DESCRIPTION OF THE PREFERRED EMBODIMENTS

Figure 1A:
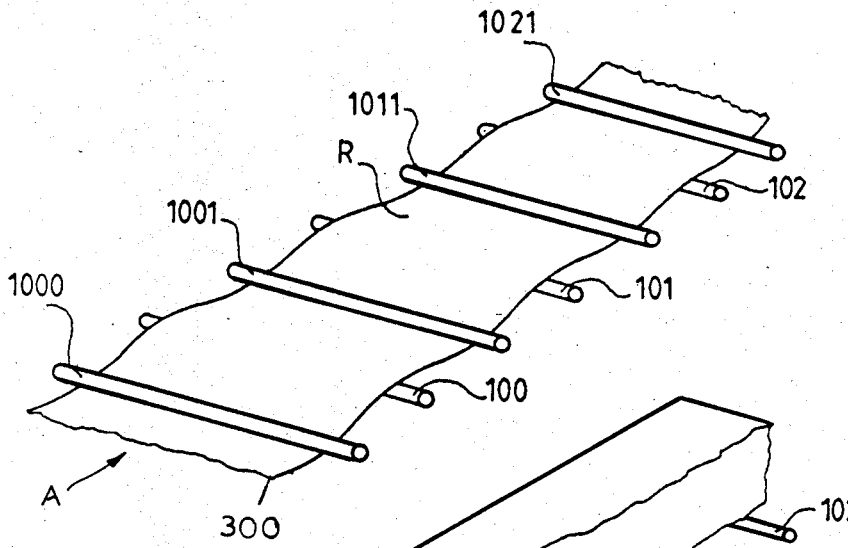
FIG. 1*a* is a perspective view of the copperation of such rollers with the material being straightened.
Figure 1:
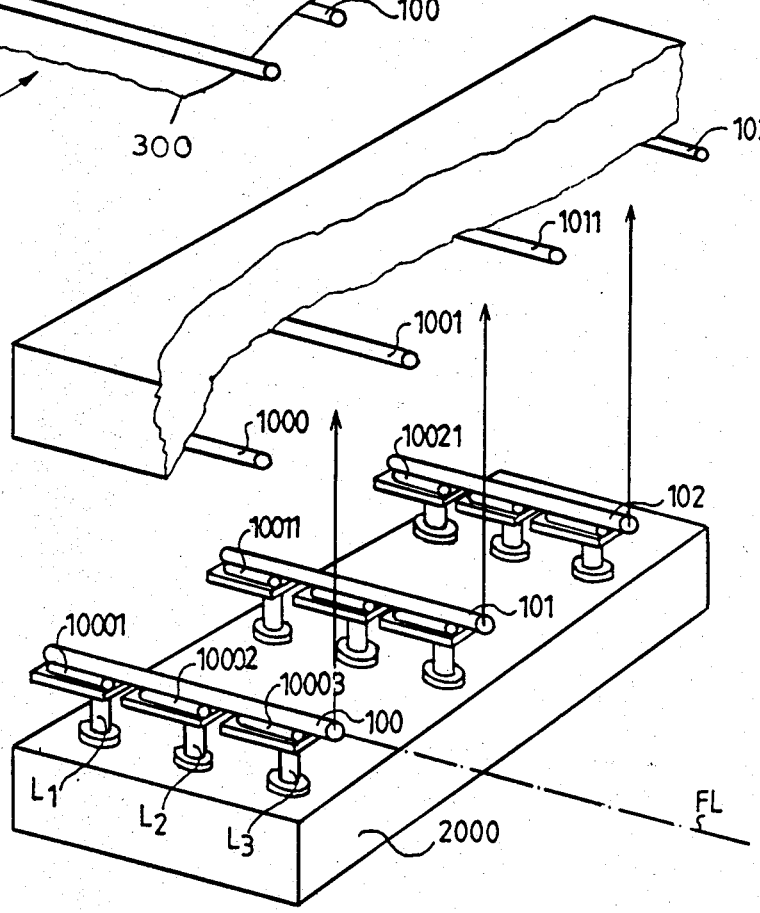
FIG. 1 is a somewhat diagrammatic exploded perspective view of the arrangement of straightening and complementary rollers in a straightening machine of the present invention.

Referring now to the drawing in detail, and first to FIG. 1 thereof, it may be seen that the reference numerals 100, 101, and 102 have been used therein to identify three consecutive straightening rollers, of which there may be more than three, while the reference numerals 1000, 1001, 1011 and 1021 denote complementary rollers, of which there may again be more in sequence than the four shown. Support roller pairs 10001, 10002 and 10003 are shown to be used to support the straightening roller 100, but here again more than three may be provided, and will be provided in many if not all instances. The illustrated straightening rollers 101 and 102 are supported in the same manner on respective roller pairs which, however, have not been identified by any reference numerals in order not to encumber the drawing and since the description of the support of the straightening roller 100 analogously applies to the support of the remaining straightening rollers, such as 101 and 102. As particularly evident from FIG. 1*a*, the straightening rollers 100, 101 and 102 and the complementrary rollers 1000, 1001, 1011 and 1021 are arranged, during the performance of a straightening operation which will be described in more detail later, at the opposite sides of a deformable sheet 300 to be straightened and alternate with one another in a direction indicated by an arrow A. In an initial position illustrated in FIG. 1, the support roller pairs 10001, 10002 and 10003 are arranged at a support roller alignment plane FL which is parallel to the axis of the respective straightening roller 100, 101 or 102 and is represented by a line in FIG. 1.

The straightening rollers 100, 101 and 102 form a straightening roller array whose support rollers are in each instance handled the same way during the adjustment by changing the positions of the support rollers. Consequently, when one of the straightening rollers is referred to or explained, the respective straightening roller array is meant in each case. Thus, when one of the support rollers 10001, 10002, and 10003 (of the straightening roller array) is positionally adjusted, that is, lifted above the support roller alignment plane FL, then the straightening roller 100, 101, or 102 (the straightening roller array), which is flexible, bends in accordance with the bending curve, when the respective straightening roller 100, 101 or 102 is otherwise not subjected to any forces.

As mentioned before, FIG. 1*a* shows the course along which the sheet material 300 to be straightened extends between the straightening rollers 100, 101 and 102, on the one hand, and the complementary rollers 1000, 1001, 1011 and 1021. The straightening effect is achieved in such a manner that, as a result of a slight tilting or inclination of the straightening roller plane with respect to the complementary roller plane, the material 300 to be straightened is stretched in the elastic and plastic deformation region at the beginning of the straightening operation, yet is later smoothened by the subsequent straightening rollers and transferred into the elastic reformation region. The angles of inclination utilized during this straightening procedure are adjusted both in the longitudinal and in the transverse direction in correspondence with the respective material 300 to be straightened.

Figure 1B:
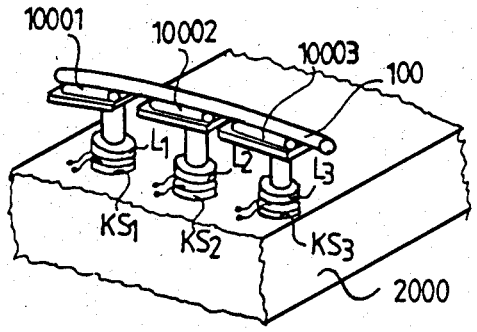
FIG. 1*b* is a fragmentary perspective view of the region of one of the straightening rollers.

A single straightening roller 100 and its bending is illustrated in FIG. 1*b*. Respective support elements L1, L2 and L3, which are for instance, constructed in a known manner as hydraulically operated sliding keys, support the support rollers 10001, 10002 and 10003 on a machine frame 2000. Herein, there can be provided measuring sensors KS1, KS2 and KS3, which may be constructed, for instance, as piezoelectric measuring transducers, by means of which the loads being supported can be measured.

Figure 2:
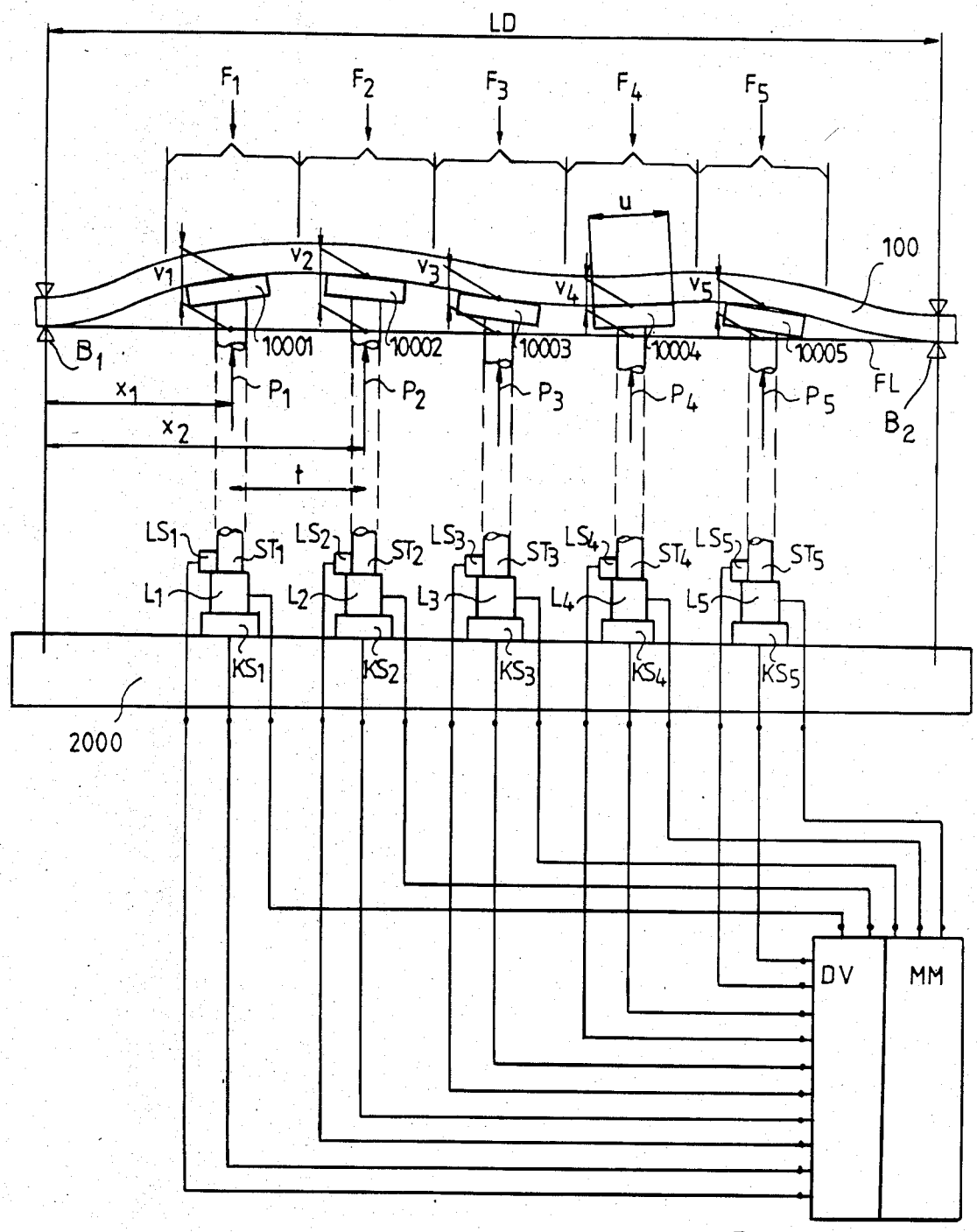
FIG. 2 is a side elevational view of a straightening roller supported on five support rollers, and associated control equipment.

FIG. 2 shows, in a somewhat schematized form of FIG. 1*b*, a modification for the case that five rather than three support rollers, identified by reference numerals 10001 to 10005, are used for supporting and acting on the straightening roller 100. In this instance, the support roller 10002 is a predeterminative roller, and the support rollers 10001, 10002, 10004 and 10005 are free rollers. The support rollers 10001 to 10005 are supported on respective support members ST1 to ST5 which are arranged at respective distances x1 to x5 from a bearing B1 which supports the straightening roller 100 at one end, while the other end of the latter is supported by another bearing B2. The distance between the straightening bearings B1 and B2 is denoted by LD. The support rollers 10001 to 10005 have a roller length u and the distance $x(i)-x(i+1)$ between the center lines of the support members ST(i) and ST(i+1) amounts to t.

The loads on the support members ST1 to ST5 are indicated as force vectors P1 to P5. These force vectors P1 to P5 result as reaction forces when the support rollers 10001 to 10005 are displaced by respective distances v1 to v5 upwardly from or beyond the straightening roller alignment plane FL, and hence are functions of the distances v1 to v5 and can be accordingly designated as P(v1) to P(v5). The magnitudes of the displacement distances v1 to v5 are measured by means of position sensors LS1 to LS5. There may additionally provided, as illustrated, respective load measuring sensors KS1 to KS5.

A good first approximation of the actual forces acting on the straightening roller 100 is the assumption that the load acting on the effective length of the straightening roller 100 due to the pressure exerted on the latter by the sheet material being straightened (omitted from FIG. 2) is uniformly distributed, resulting in partial loads F1 to F5 acting on the straightening roller 100 at the regions of the respective support rollers 10001 to 10005. Now, a matrix /Aii/ of the above-mentioned equation (1) can be calculated from the parameters of the machine and of the material to be straightened on the basis of the relationships described below in Example I. Herein, the two kinds of support loads $P>0$ and $P>0$ are described in the specified manner by "signum functions" sig(i).

EXAMPLE I

Calculation Scheme for the Calculation of the Matrix of Parametric Values in the System of Equations $$f_k = \sum_{i=1}^{k} P_i a_{ik} - F b_k$$

wherein:

$a_{ik}$=matrix elements $b_k$=parametric values

F=straightening force $P_i$=support force at the i-th support member ST i,k=number 1 . . . N of the support members ST, wherein N=total number of the support members ST $f_k$=displacement distance of the k-th support member it applies for the calculation of the matrix elements $a_{ik}$:

$$12 \cdot E \cdot I \cdot a_{ik} = 4 \cdot (LD - x_i) \cdot x_k \cdot LD$$
$$-2 \cdot (LD - x_i) \cdot (x_k - u/2)^3/LD$$
$$-2 \cdot (LD - x_i) \cdot (x_k + u/2)^3/LD$$
$$-2 \cdot (LD - x_i - u/2)^3 \cdot x_k/LD$$
$$-2 \cdot (LD - x_i + u/2)^3 \cdot x_k/LD$$
$$+2 \cdot sig_1 \cdot (x_k - x_i)^3$$
$$+sig_2 \cdot (x_k - x_i - u)^3$$
$$+sig_3 \cdot (x_k - x_i + u)^3$$

wherein:

E=modulus of elasticity of the straightening roller material

I=straightening roller moment of inertia

LD=straightening roller bearing distance $x_i, x_k$=coordinates of the support centers characterized by the numbers i or k u=support roller carrying length Signum values of the sectionally defined function are:

$sig_1=0$, when $(x_k-x_i) \leqq 0$, $sig_1=1$, when $(x_k-x_i)>0$, $sig_2=0$, when $(x_k-x_i-u) \leqq 0$, $sig_2=1$, when $(x_k-x_i-u)>0$, $sig_3=0$, when $(x_k-x_i+u) \leqq 0$, $sig_3=1$, when $(x_k-x_i+u)>0$.

The parametric values $b_k$ are calculated as follows:

$$48 \cdot E \cdot I \cdot b_k = 4 \cdot (2LD - 1 - 2c) \cdot x_k \cdot LD$$
$$-2 \cdot (2LD - 1 - 2c) \cdot (x_k - u/2)^3/LD$$
$$-2 \cdot (2LD - 1 - 2c) \cdot (x_k + u/2)^3/LD$$
$$-2 \cdot (LD - c)^4 \cdot x_k/LD/1$$
$$+2 \cdot (LD - 1 - c)^4 \cdot x_k/LD/1$$
$$+sig_4 \cdot (x_k - c - u/2)^4/1$$
$$+sig_5 \cdot (x_k - c + u/2)^4/1$$
$$-sig_6 \cdot (x_k - c - 1 - u/2)^4/1$$
$$+sig_7 \cdot (x_k - c - 1 + u/2)^4/1$$

wherein:

l=width of the material to be straightened c=edge distance of the material to be straightened from the zero coordinate point.

Signum values of the sectionally defined function are:

$sig_4=0$, when $(x_k-c-u/2) \leqq 0$, $sig_4=1$, when $(x_k-c-u/2)>0$, $sig_5=0$, when $(x_k-c+u/2) \leqq 0$, $sig_5=1$, when $(x_k-c+u/2)>0$, $sig_6=0$, when $(x_k-c-1-u/2) \leqq 0$, $sig_6=1$, when $(x_k-c-1-u/2)>0$, $sig_7=0$, when $(x_k-c-1+u/2) \leqq 0$, $sig_7=1$, when $(x_k-c-1+u/2)>0$.

Such a matrix A(ii) is calculated in the following Examples IIa and IIb (for the purpose of overview and lucidity for the case where three support rollers are being used), with the parameters of the straightening roller as specified there. Inverted matrices A/exp−1 of Example IIb follow from the matrix /A/ of Example IIa.

The matrix /A/ must be newly calculated for each machine, for each material to be straightened, and for each load distribution F(i). However, it remains unchanged during the straigh ening process (if the loads F(i) are constant). The inverted matrices /A/exp−1 of Example IIb are calculated for typical loading cases (in such cases, unit vectors occur at those locations where negative loads were present at the support roller), and they serve for determining the support roller elevations or distances beyond the plane FL.

EXAMPLE IIa

Matrix Values $a_{ik}$ for the Configuration straightening roller diameter: 45 mm
straigtening roller bearing distance: 1000 mm
number of supports: 3
support center distance: 250 mm
support roller length: 100 mm

| Matrix Element $a_{ik}$ of the above Configuration | | | |
|---|---|---|---|
| | a/i,1/ | a/i,2/ | a/i,3/ |
| a/1,k/ | 0,000267 | 0,000331 | 0,000212 |
| a/2,k/ | 0,000331 | 0,000479 | 0,000331 |
| a/3,k/ | 0,000212 | 0,000331 | 0,000267 |

EXAMPLE IIb

| | aa/i,1/ | aa/i,2/ | aa/i,3/ |
|---|---|---|---|
| | Coefficient inverted matrix No. 1 | | |
| aa/1,k/ | 33544,086 | −33882,484 | 15428,064 |
| aa/2,k/ | −33882,484 | 48972,164 | −33882,484 |
| aa/3,k/ | 15428,064 | −33882,484 | 33544,086 |
| | Coefficient inverted matrix No. 2 | | |
| aa/1,k/ | 26448,203 | −18298,785 | 0,0 |
| aa/2,k/ | −18298,785 | 14747,867 | 0,0 |
| aa/3,k/ | −0,460 | 1,010 | −1,000 |
| | Coefficient inverted matrix No. 3 | | |
| aa/1,k/ | 10101,732 | 0,0 | −8014,292 |
| aa/2,k/ | 0,692 | −1,000 | 0,692 |
| aa/3,k/ | −8014,292 | 0,0 | 10101,732 |
| | Coefficient inverted matrix No. 4 | | |
| aa/1,k/ | 3743,529 | 0,0 | 0,0 |
| aa/2,k/ | 1,241 | −1,000 | 0,0 |
| aa/3,k/ | 0,793 | 0,0 | −1,000 |
| | Coefficient inverted matrix No. 5 | | |
| aa/1,k/ | −1,000 | 1,010 | −0,460 |
| aa/2,k/ | 0,0 | 14747,867 | −18298,785 |
| aa/3,k/ | 0,0 | −18298,785 | 26448,203 |
| | Coefficient inverted matrix No. 6 | | |
| aa/1,k/ | −1,000 | 0,692 | 0,0 |
| aa/2,k/ | 0,0 | 2087,441 | 0,0 |

-continued

| | aa/i,1/ | aa/i,2/ | aa/i,3/ |
|---|---|---|---|
| aa/3,k/ | 0,0 | 0,692 | −1,000 |
| | Coefficient inverted matrix No. 7 | | |
| aa/1,k/ | −1,000 | 0,0 | 0,793 |
| aa/2,k/ | 0,0 | −1,000 | 1,241 |
| aa/3,k/ | 0,0 | 0,0 | 3743,529 |
| | Coefficient inverted matrix No. 8 | | |
| aa/1,k/ | −1,000 | 0,0 | 0,0 |
| aa/2,k/ | 0,0 | −1,000 | 0,0 |
| aa/3,k/ | 0,0 | 0,0 | −1,000 |

Now, in the following Exmaple III, the control operation will be described for the case of a straightening roller supported by five support roller, with K=1 and N−K=4. Herein, it is to be realized that, with five support rollers, there are already 2exp5, that is, 32 inverted matrices. Thus, in the presented Example III, only the respectively used matrices are described.

EXAMPLE III

Examplary Calculation for one Support Adjustment

1. Configuration

| | | |
|---|---|---|
| Straightening roller diameter | d = | 45 mm |
| Moment of Inertia | I = | 201289 mm$^4$ |
| Modules of elasticity | E = | 210000 N/mm$^2$ |
| Straightening roller bearing distance | LD = | 1500 mm |
| Number of supports | N = | 5 |
| Support roller distance | t = | 250 mm |
| Support roller length | u = | 100 mm |

Matrix elements $a_{ik}$ of the configuration

| | a/i,1/ | a/i,2/ | a/i,3/ | a/i,4/ | a/i,5/ |
|---|---|---|---|---|---|
| a/1,k/ | 0,000502 | 0,000770 | 0,000793 | 0,000632 | 0,000347 |
| a/2,k/ | 0,000770 | 0,001296 | 0,001402 | 0,001140 | 0,000632 |
| a/3,k/ | 0,000793 | 0,001402 | 0,001642 | 0,001402 | 0,000793 |
| a/4,k/ | 0,000632 | 0,001140 | 0,001402 | 0,001296 | 0,000770 |
| a/5,k/ | 0,000347 | 0,000632 | 0,000793 | 0,000770 | 0,000502 |

2. Straightening force

| | |
|---|---|
| Width of the material to be straightened | F = 40 000 N |
| Edge distance of the material to be straightened from the zero coordinate point c = | 1 = 1 500 mm<br>0 |

| Parametric values $b_k$ | Values $F \cdot b_k$ |
|---|---|
| $b_1$ = 0,000523 | $F \cdot b_1$ = 20,92 |
| $b_2$ = 0,000899 | $F \cdot b_2$ = 35,96 |
| $b_3$ = 0,001034 | $F \cdot b_3$ = 41,36 |
| $b_4$ = 0,000899 | $F \cdot b_4$ = 35,96 |
| $b_5$ = 0,000523 | $F \cdot b_5$ = 20,92 |

3. Support positions $f_k$ (initial values)

| | $f_1$ | $f_2$ | $f_3$ |
|---|---|---|---|
| | 0,3 mm | 0,6 mm | 0,5 mm |
| | $f_1 + F \cdot b_1$ = | $f_2 + F \cdot b_2$ = | $f_3 + F \cdot b_3$ = |
| | 21,22 | 36,56 | 41,86 |
| | Coefficient inverted matrix | | |
| | aa/i,1/ | aa/i,2/ | aa/i,3/ |
| aa/1,k/ | 33783,594 | −34645,375 | 17618,434 |
| aa/2,k/ | −34645,379 | 51402,188 | −40856,852 |
| aa/3,k/ | 17618,439 | −40856,852 | 53353,277 |
| aa/4,k/ | −6211,103 | 19569,326 | −40856,852 |
| aa/5,k/ | '1950,594 | −621,101 | 17618,434 |

| | $f_4$ | $f_5$ |
|---|---|---|
| | 0,4 mm | 0,3 mm |
| | $f_4 + F \cdot b_4$ = | $f_5 + F \cdot b_5$ = |
| | 36,36 | 21,22 |
| | Coefficient inverted matrix | |
| | aa/i,4/ | aa/i,5/ |
| aa/1,k/ | −6211,101 | 1950,594 |
| aa/2,k/ | 19569,326 | −6211,103 |
| aa/3,k/ | −40856,852 | 17618,439 |
| aa/4,k/ | 51402,188 | −34645,379 |
| aa/5,k/ | −34645,375 | 33783,594 |

Calculation of the support forces $P_i$

-continued

Calculation scheme:

$P_1 = (f_l + F \cdot b_1) \cdot aa/1,1/ + (f_2 + F \cdot b_2) \cdot aa/1,2/ + (f_3 + F \cdot b_3) \cdot aa/1,3/ + (f_4 + F \cdot b_4) \cdot aa/1,4/ + (f_5 + F \cdot b_5) \cdot aa/1,5/$ $P_2 = (f_l + F \cdot b_1)\, aa/2,1/ + (f_2 + F \cdot b_2) \cdot aa/2,2/ + (f_3 + F \cdot b_3) \cdot aa/2,3/ + (f_4 + F \cdot b_4)\, aa/2,4/ + (f_5 + F \cdot b_5) \cdot aa/2,5/$ $P_5 = (f_l + F \cdot b_1)\, aa/5,1/ + (f_2 + F\, b_2)\, aa/5,2/ + (f_3 + F \cdot b_3) \cdot aa/5,3/ + (f_4 + F \cdot b_4)\, aa/5,4/ + (f_5 + F\, b_5) \cdot aa/5,5/$ Results:

| | |
|---|---|
| $P_1$ = 3317 N | All support forces $P_i$ are ≧ 0. |
| $P_2$ = 13562 N | There is present a definitionally |
| $P_3$ = 1813 N | equalized position system. |
| $P_4$ = 7196 N | |
| $P_5$ = 9003 N | |

4. Support adjustment (Example)

4.1 In the support position system according to print 3, the support No. 2 is positionally adjusted and brought into the position $F_2$ = 1.0 mm.

| | $f_1$ | $f_2$ | $f_3$ |
|---|---|---|---|
| | 0,3 mm | 1,0 mm | 0,5 mm |
| | $f_1 + F \cdot b_1$ = | $f_2 + F \cdot b_2$ = | $f_3 + F \cdot b_3$ = |
| | 21,22 | 36,96 | 41,86 |
| | Coefficient inverted matrix | | |
| | aa/i,1/ | aa/i,2/ | aa/i,3/ |
| aa/1,k/ | 33783,594 | −34645,375 | 17618,434 |
| aa/2,k/ | −34645,379 | 51402,188 | −40856,852 |
| aa/3,k/ | 17618,439 | −40856,852 | 53353,277 |
| aa/4,k/ | −6211,103 | 19569,326 | −40856,852 |
| aa/5,k/ | 1950,594 | −6211,101 | 17618,434 |

| | $f_4$ | $f_5$ |
|---|---|---|
| | 0,4 mm | 0,3 mm |
| | $f_4 + F \cdot b_4$ = | $f_5 + F \cdot b_5$ = |
| | 36,36 | 21,22 |
| | Coefficient inverted matrix | |
| | aa/i,4/ | aa/i,5/ |
| aa/1,k/ | −6211,101 | 1950,594 |
| aa/2,k/ | 19569,326 | −6211,103 |
| aa/3,k/ | −40856,852 | 17618,439 |
| aa/4,k/ | 51402,188 | −34645,379 |
| aa/5,k/ | −34645,375 | 33783,594 |

Calculation of the support forces (calculation scheme - see point 3)

Results:

| | |
|---|---|
| $P_1$ = −10542 N | Negative load values have resulted at the |
| $P_2$ = 34123 N | supports Nos. 1 and 3. Therefore, $P_1$ and $P_3$ |
| $P_3$ = −14530 N | must be set to zero. The remaining support |
| $P_4$ = 15023 N | forces have to be recalculated simultaneously |
| $P_5$ = 6519 N | with the determination of the corresponding |
| | position values for the supports Nos. 1 and 3. |

4.2 calculation for the determination of the new support position values and support forces.

| | | | |
|---|---|---|---|
| | | $f_2$ = | |
| | | 1,0 mm | |
| | | $f_2 + F \cdot b_2$ = | |
| | $P_1$ = 0 | 36,96 | $P_3$ = 0 |
| | Coefficient inverted matrix | | |
| | aa/i,1/ | aa/i,2/ | aa/i,3/ |
| aa/1,k/ | −1,000 | 0,756 | 0,0 |
| aa/2,k/ | 0,0 | 4114,033 | 0,0 |
| aa/3,k/ | 0,0 | 0,516 | −1,000 |
| aa/4,k/ | 0,0 | −6210,768 | 0,0 |
| aa/5,k/ | 0,0 | 4355,377 | 0,0 |

| | $f_4$ = | $f_5$ = |
|---|---|---|
| | 0,4 mm | 0,3 mm |
| | $f_4 + F \cdot b_4$ = | $f_5 + F \cdot b_5$ = |
| | 46,46 | 21,22 |
| | Coefficient inverted matrix | |
| | aa/i,4/ | aa/i,5/ |
| aa/1,k/ | −0,260 | 0,138 |
| aa/2,k/ | −6210,768 | 4355,377 |
| aa/3,k/ | 0,852 | '−0,376 |
| aa/4,k/ | 18219,316 | −20146,656 |
| aa/5,k/ | −20146,656 | 27430,748 |

Calculation scheme:

-continued

| | |
|---|---|
| $(f'_1 + F \cdot b_1) =$ | $P_1 \cdot aa/1,1/ + (f_2 + F \cdot b_b) \cdot aa/1,2/ + P_3 \cdot aa/1,3/ + (f_4 + F \cdot b_4) \cdot aa/1,4/ + (f_5 + F \cdot b_5) \cdot aa/1,5/$ |
| $P_2 =$ | $P_1 \cdot aa/2,1/ + (f_2 + F \cdot b_2) \cdot aa/2,2/ + P_3 \cdot p\ aa/2,3/ + (f_4 + F \cdot b_4) \cdot aa/2,4/ + (f_5 + F \cdot b_5) \cdot aa/2,5/$ |
| $(f'_3 + F \cdot b_3) =$ | $P_1 \cdot aa/3,1/ + (f_2 + F \cdot b_2) \cdot aa/3,2/ + P_3 \cdot aa/3,3/ + (f_4 + F \cdot b_4) \cdot aa/3,4/ + (f_5 + F \cdot b_5) \cdot aa/3,5/$ |
| $P_4 =$ | $P_1 \cdot aa/4,1/ + (f_2 + F \cdot b_2)aa \cdot aa/4,2/ + P_3 \cdot aa/4,3/ + (f_4 + F \cdot b_4) \cdot aa/4,4/ + (f_5 + F \cdot b_5) \cdot aa/4,5/$ |
| $P_5 =$ | $P_1 \cdot aa/5,1/ + (f_2 + F \cdot b_2) \cdot aa/5,3/ + P_3 \cdot aa/5,3/ + (f_4 + F \cdot b_4) \cdot aa/5,4/ + (f_5 + F \cdot b_5) \cdot aa/5,5/$ |

Results:

| | |
|---|---|
| $f'_1 + F \cdot b_1 = 21{,}42$ mm | All of the established support forces are positive. Thus, the positional system is definitionally equalized. For the new positional values of the supports 1 and 3, it applies: $f'_1 = 21{,}42-20{,}92 = 0{,}5$ mm $f'_3 = 42{,}07-41{,}36 = 0{,}71$ mm |
| $P_2 = 18652$ N | |
| $f'_3 + F \cdot b_3 = 42{,}07$ mm | |
| $P_4 = 5392$ N | |
| $P_5 = 10523$ N | |

4.3 Summary of the described adjustment operation.

| | Support positions | | | | |
|---|---|---|---|---|---|
| | $f_1$ | $f_2$ | $f_3$ | $f_4$ | $f_5$ |
| Initial position | 0,3 mm | 0,6 mm | 0,5 mm | 0,4 mm | 0,3 mm |
| Predeterminative free adjustment of the support No. 2 | ↓ | ↓ 1,0 mm | ↓ | | |
| Controlled after adjustment of the supports Nos. 1 and 2 | 0,5 mm | | 0,71 mm | | |
| New, equalized positional system | 0,5 mm | 1,0 mm | 0,71 mm | 0,4 mm | 0,3 mm |

The adjustment of the arrangement is accomplished in such a manner that the measured values obtained from the position sensors LS1 to LS5 are fed to a computer DV, that upon adjustment of the support members ST1 to ST2 this adjustment also becomes known and the calculating operation is triggered thereby, wherein the necessary matrices and their inverted values are read by the computer DV out of a memory MM.

In the event that load measuring probes or sensors KS1 to KS5 are provided, then the condition $P(i)>0$ can be satisfied or maintained without the calculation of the matrices during the "upward control", that is, during the elevating adjustment of the straightening rollers, by providing corresponding readjustment commands and supplying the same to the adjustment means Li of the free support rollers. The readjustment commands are triggered when $P(i, t1)<P(i, t2)$, that is, when the time differential quotient is positive. However, the readjustment of the free support rollers can herein take place only for so long as the adjustment of the predeterminative support rollers, inasmuch as otherwise the normal, operation-caused load changes would also trigger readjustments, which would lead to instability of the arrangement.

The "downward control", that is, the diminishment of the immersipn depth of the straightening roller, can always be accomplished in such a manner that the positions established during the "upward control" are reduced by resorting to the use of a similarity transformation.

It will be understood that each of the elements described above, or two or more together, may also find a useful application in other types of arrangements differing from the type described above.

While the invention has been illustrated and described as embodied in a method for straightening deformable sheetshaped materials during advancement thereof, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims; We claim:

1. A method of adjusting the positions of N support rollers which support a flexible straightening roller in a machine for straightening deformable sheet-shaped materials during the advancement of the latter between arrays of straightening and complementary rollers which are situated downstream of one another as considered in the advancement direction, with the straightening rollers alternating with and being positionally adjustable with respect to the complementary rollers to selectively deform the respective sheet-shaped material in-between the complementary rollers, comprising the steps of freely positionally adjusting a selected K of the support rollers, with K being smaller than N, beyond a support roller alignment plane; and automatically positionally adjusting the remaining N-K support rollers relative to the support roller alignment plane in dependence on the positional adjustment of the K support rollers until all of the support rollers abut the straightening rollers, on the basis of simultaneous calculation of the expression $$V/=/A/\cdot P/+F/$$

wherein

V/=a multidimensional vector of the support roller adjustment

/A/=a matrix of parametric values

P/=a multidimensional vector of support forces, and

F/=a multidimensional vector of a straightening load.

2. The method according to claim 1, wherein said automatically positionally adjusting step includes characterizing the adjustment of the machine at the beginning of such step by a system of simultaneous equations $$V/(f(x1), \ldots, f(xi)) = /Aii/\cdot P/(p(x1), \ldots, p(xi)) + F/(x1 \ldots xi), \quad (1)$$

wherein V/=an i-dimensional vector of displacements f at xi,

P/=an i-dimensional vector of support forces p at xi,

F/=load distribution over the straightening roller, f(xi)=displacement of the support roller at the position xi, and /Aii/=a quadratic matrix of machine constants, or, in an abbreviated form, $$V/(f1, \ldots, fi)\ /A/\cdot P/(p1, \ldots pi) + F/(i), \quad (2)$$

characterizing the adjustment of the machine at the end of such step by a system of simultaneous equations $$V/(f1, v2, \ldots vk, fi)\ /A/\cdot P/(v1, v2, \ldots, vk, vi)+F/(i) \quad (3)$$

wherein vi=components changed with respect to previous ones, verifying the newly adjusted positions of the support rollers by utilizing the expression $$P/(v1, v2, \ldots, vk, vi)-F/(i)=/A/exp-1\cdot V/(f1, v2, \ldots, vk, fi), \quad (4)$$

wherein

/A/exp−1=inverted matrix, upon occurrence of forces smaller than zero, calculating an new set of adjustments for automatic readjustment of the machine from the expression $$v/(v1, v2, \ldots, vi)=/A/\cdot P/(v1, o2, \ldots, ok, vi)+F/(i), \quad (5)$$

wherein oi mandated support load zero, so long as the support loads obtained from the expression (4) for this set of adjustments do not include any negative forces.

3. The method according to claim 1, wherein said automatically positionally adjusting step includes diminishing the adjusted distances of the support rollers in a downward control operation by a similarity transformation of adjustments of the support rollers obtained during an increase of the adjusted distances of the support rollers in an upward control operation.

4. The method as defined in claim 1, wherein said freely and automatically positionally adjusting steps are performed in three stages during a first of which the loads applied to said remaining N-K support rollers all have positive values after the performance of said freely positionally adjusting step and said automatically adjusting step is performed only simultaneously with said freely positionally adjusting step, during a second one of which the positional adjustment of said remaining N-K support rollers is calculated from the expression V/=/A/·P/+F/ and such adjustment is performed based on the calculated values, and during a third one of which a downward control of the extent of displacement of said support rollers is performed by the use of a similarity transformation while maintaining relative support roller displacement extents.

5. The method as defined in claim 1, and further comprising the step of minimizing to a predetermined value a total pressure resulting from the summation of the support loads of all of said support rollers.

6. The method as defined in claim 1, wherein the deformable sheet-shaped materials exert load distribution forces that are distributed over the straightening rollers, the straightening rollers having a deformation due to the load distribution forces exerted by the deformable sheet-shaped materials, the step of automatically positionally adjusting the remaining N-K support rollers being effected so that the deformation of the straightening rollers remains generally unchanged during the entire step of freely positionally adjusting a selected K of the support rollers as well as during the entire step of automatically positionally adjusting the remaining N-K support rollers.

7. The method as defined in claim 1, wherein the deformable sheet-shaped materials exert load distribution forces that are distributed over the straightening rollers, the step of freely positionally adjusting a selected K of the support rollers causing distributed load changes in the load distribution forces to take place, the step of automatically positionally adjusting the remaining N-K support rollers including automatically positionally adjusting the remaining N-K support rollers to intercept each of the distributed load changes that takes place because of the freely positionally adjusting of a selected K of the support rollers.

* * * * *